US007967929B1

(12) United States Patent
Stec, III et al.

(10) Patent No.: US 7,967,929 B1
(45) Date of Patent: Jun. 28, 2011

(54) METHODS FOR MAKING AND USING HIGH EXPLOSIVE FILLS FOR MEMS DEVICES

(75) Inventors: Daniel Stec, III, Long Valley, NJ (US); Amy Wilson, Blairstown, NJ (US); Brian E. Fuchs, Hackettstown, NJ (US); Neha Mehta, Succasunna, NJ (US); Paula Cook, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/647,707

(22) Filed: Dec. 28, 2009

Related U.S. Application Data

(63) Continuation-in-part of application No. 11/307,626, filed on Feb. 15, 2006, now abandoned, which is a continuation-in-part of application No. 10/248,904, filed on Feb. 28, 2003, now Pat. No. 7,052,562.

(60) Provisional application No. 61/116,027, filed on Nov. 19, 2008.

(51) Int. Cl.
*C06B 25/00* (2006.01)
*C06B 25/34* (2006.01)
*D03D 23/00* (2006.01)
*D03D 43/00* (2006.01)

(52) U.S. Cl. ..... 149/92; 149/88; 149/108.8; 149/109.4

(58) Field of Classification Search ..... 149/92
See application file for complete search history.

(56) References Cited

U.S. PATENT DOCUMENTS 3,698,316 A * 10/1972 Evans ..... 102/275.8
7,052,562 B1 * 5/2006 Stec et al. ..... 149/19.92

* cited by examiner

*Primary Examiner* — James E McDonough
(74) *Attorney, Agent, or Firm* — Henry S. Goldfine

(57) ABSTRACT

Secondary crystalline high explosives are disclosed which are suitable for filling very small volume loading holes in micro-electric initiators for micro-electro-mechanical mechanisms (MEMS), used as safe and arm (S&A) devices. The explosives are prepared by adding the such a high explosive to an aqueous first volatile mobile phase, adding such a high explosive to a non-aqueous second volatile mobile phase, mixing the first and second volatile mobile phases and then loading the combined phases into the MEMS device and allowing the aqueous and non-aqueous solvents to evaporate depositing the high explosive. Enhanced adhesion between the deposited high explosive and enhanced rheological properties can be obtained by adding a polymeric binder to both mobile phases.

4 Claims, 3 Drawing Sheets

METHODS FOR MAKING AND USING HIGH EXPLOSIVE FILLS FOR MEMS DEVICES

CROSS REFERENCE TO RELATED APPLICATIONS

This application is a continuation-in-part of co-pending prior application Ser. No. 11/307,626 filed, Feb. 15, 2006, which in turn is a continuation-in-part of prior application Ser. No. 10/248,904, filed Feb. 28, 2003; the entire file wrapper contents of both prior applications are hereby incorporated herein by reference as though each is fully set forth herein; this application also claims the benefit under 35 USC §119(e) of U.S. provisional application 61/116,027, filed Nov. 19, 2008.

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention relates to a method for the precise deposition of the energetic fills that form the detonation train within ultra-miniature safety-and-arming devices used for projected munitions, and more specifically wherein the crystalline high explosive materials which form the energetic fills are deposited using a combination of aqueous and non-aqueous vehicles.

2. Related Art

Modern explosive projectiles, such as mortar shells, artillery shells and other similar projectiles, normally have a safety-and-arming (S&A) device which operates to permit detonation of the explosive only after the particular projectile has been fired or launched. With the relatively recent emergence of smart weapon systems that are lighter, smaller, and have greater lethality and survivability, correspondingly smaller and more reliable S&A devices have been developed, including the development and use of Micro Electro-mechanical Mechanisms (MEMS) as S&A devices, such as the MEMS device disclosed in U.S. Pat. No. 6,167,809 to Robinson et al., issued Jan. 2, 2001, which is hereby incorporated herein by reference. Such MEMS S&A devices typically use a combination of mechanical mechanisms, which only under the extreme physical conditions of firing or launch create an alignment of very small explosive charges, a firing train, which when detonated by the weapon's fuze system will allow the detonation of the projectile's main charge. As disclosed in U.S. Pat. No. 6,167,809, MEMS S&A devices are preferably fabricated on a die approximately one square centimeter or less in area, wherein the very small explosive charges, micro-liter volumes, must to be precisely deposited within a series of holes and channels that comprise the firing train.

Typically, within MEMS devices, there are primary and secondary explosives; where primary explosives are very sensitive explosives that respond to a small "insult," while secondary explosives usually require a strong shock to detonate. The primary explosives within a MEMS fire train are used to initiate the train, being detonated by a small electrical charge from the fuze circuitry of the projectile. Methodology for depositing the requisite very small quantities of primary explosives along a bridgewire are known. However, the balance of the fire train within the MEMS device is filled with a secondary explosive to minimize the potential for a premature detonation. This secondary explosive, filled within the holes and channels which form the firing train of the MEMS device, is the subject of this invention.

The basic standard methods for loading secondary energetic or explosive materials into munitions are press-loading, and cast loading (whether using melt-cast or cast-cure techniques). The obvious alternative method of loading explosives as a slurry, is not economically feasible due to the excessively long drying time to evaporate the slurry medium—which if not fully evaporated can lead to defects such as porosity, voids, cracks and entrapped slurry medium and the like, which can cause a fielded munition to have safety and performance problems.

Press-loading, as the means to deliver the explosive to the fixture, presents difficulties because of the very small volume of solid explosive required in each MEMS hole or channel. To obtain the desired explosive effect along the initiation train, compression of this explosive material is critical and generally a density per unit volume of greater than 95%, i.e. 95% of the Theoretical Maximum Density (TMD), is required. Such a high minimum density avoids cracks, porosity, voids, and the like, which can result, as stated above, in safety and performance problems. Further, because of the delicateness of the materials of construction of the ultra-miniature MEMS fixture, press loading of the energetic fill into the fixture to meet this high minimum % TMD is not a viable option.

One alternative potential approach would be to prepare a pellet of the energetic material externally of the fixture, and then load the pellet into the fixture. To complete the process, in order to maintain the pellet in place, some kind of adhesive would have to be applied to the pellet, e.g., on the side thereof, or to the wall of the fixture. It will be appreciated that such a process would be difficult due to being cumbersome and relatively costly.

As was also mentioned previously, another alternative is casting of the energetic fill into the fixture, either by melt casting or cast curing. Melt casting basically entails heating a substance to a temperature above its melting point, adding any needed ancillary materials to the melt, pouring the mixture into the volume to be filled, and allowing the fill to solidify in place. Among other problems with this approach, because of the very small delivery volumes involved in the firing train within MEMS devices, heat loss to the ambient environment would be a problem and, in this regard, can result in the energetic material beginning to solidify before being emplaced.

Cast curing basically entails mixing the substance to be cast in a liquid polymer mixed with a cross-linking reagent. The resultant cast mixture has a finite "pot life" after which the viscosity of the mixture increases due to the process of chemical crosslinking. This change in rheological properties can cause difficulty in the delivery into the fixture of energetic material prepared in this manner.

There are, of course, a number of state-of-the-art delivery devices for the delivery of small volumes of materials including ink jet printing. The latter is a mature technology that can be used to accurately deliver small volumes of material. However, the present technology is unsuitable for delivering energetic materials for two reasons. First, most inks used for ink jet printing are dye-based, i.e., the colorant dye is dissolved in the fluid medium, and although there are pigment-based ink jet inks available wherein the colorant is an undissolved crystalline material, the undissolved solids are of a sub-micron particle size. Important secondary high explosives such as CL-20 (epsilon HNIW) are not presently available in a sub-micron particle size. Further, in an ink jet printer, the ink is typically delivered from the print head by a piezoelectric discharge that ejects droplets of ink at elevated pressure and temperature onto the printing substrate; the combination of an electric discharge and high temperature/pressure can be a safety hazard when attempting to deliver energetic materials.

Considering the above factors, there is a need in the art for a method to effectively, safely, and precisely load explosive charges, in the micro-liter volumes, into the holes and channels that comprise the firing train within MEMS S&A devices.

SUMMARY OF INVENTION

The present invention involves providing a secondary crystalline high explosive material, to fill the very small volumes of the holes and channels that form MEMS S&A "micro" explosive firing initiation trains, which fill is free of the problems discussed above. In accordance with a first aspect of the invention, there is provided a first volatile mobile phase in the form of an aqueous solvent, into which the secondary explosive is added to form a first slurry, emulsion, or paste, and a second volatile mobile phase in the form of a non-aqueous solvent or combination of non-aqueous solvents, into which the secondary explosive is added to form a second slurry, emulsion, or paste; which first and second slurries, emulsions, or pastes are combined into a fill that is loaded into the holes or channels of the subject MEMS S&A device. Surprisingly, not only does the subject aspect inventive fill dry in an acceptable time period, i.e. within about 12-24 hours at ambient temperature, or about 4 hours at an elevated temperature of from about 40 to 65 degrees Centigrade; but, even though the subject fill has a % TMD of approximately 90%, significantly less than fills of the prior art, the subject fill functions properly as a MEMS firing train. Quite unexpectedly, the lower % TMD fill of the inventive formulation not only adheres well to the very small holes and channels of the MEMS S&A device; but, has the necessary physical strength and integrity to overcome any tendency to form the cracks, porosity, voids, and the like, which resulted in unacceptable defects in the prior art fills.

In one embodiment, the step of loading the slurry, emulsion, or paste comprises placing the slurry, emulsion, or paste on a blade member and wiping the blade member over the fixture so as to force the slurry, emulsion, or paste into the loading hole in the fixture.

In another embodiment, the step of loading the slurry, emulsion, or paste comprises placing the paste, emulsion, or slurry in a contained space having an outlet orifice therein, and dispensing the paste or slurry through the orifice into the hole in the fixture.

In a particular implementation of this orifice delivery embodiment, the method employs a pipette for dispensing the paste or slurry. In another preferred implementation, the method employs a syringe for dispensing the paste and slurry and a plunger of the syringe is used to force the paste or slurry, through the orifice. In yet another implementation, the method employs a pump for dispensing the paste or slurry. Advantageously, the pump comprises a positive displacement pump. In another advantageous approach, the pump comprises a peristaltic pump.

Alternatively, the subject inventive method further comprises incorporating at least one volatile mobile phase so as to partially dissolve the energetic material to form the slurry, emulsion, or paste, such that, upon evaporation of the at least one mobile phrase, the dissolved energetic material precipitates and thus adheres to a portion of the fixture forming the loading hole.

In another preferred implementation, the method further comprises incorporating a polymeric binder into the slurry, emulsion, or paste so as to provide adherence between crystals of the polycrystalline energetic material and a portion of the fixture forming said loading hole. The amount of binder preferably ranges between 0.01 and 10 weight percent of the energetic material, preferably about 5 weight percent energetic; however, surprisingly, a binder loading as low as 0.01 to 0.5 weight percent with respect to the explosive fill, was found to improve the physical integrity of the loaded secondary explosive, without degrading or interfering with its energetic performance. Advantageously, the binder is dissolved in the slurry, emulsion, or paste. In another advantageous approach, the binder is incorporated into the slurry or paste as a latex suspension. In yet another advantageous approach, the binder is incorporated into the slurry or paste as an emulsion.

Surprisingly, and most preferably, when a first binder is added to the aqueous first volatile mobile phase and a second binder is added to the second volatile mobile phase, and the first and second volatile mobile phases are combined, the resulting combination, i.e. the subject inventive high explosive fill, does not exhibit the rheological property of forming thin filaments or strands when delivered onto the substrates comprising the holes and channels of the MEMS S&A device.

Further features and advantages of the present invention will be set forth in, or apparent from, the detailed description of preferred embodiments thereof which follows.

DETAILED DESCRIPTION

Figure 1:
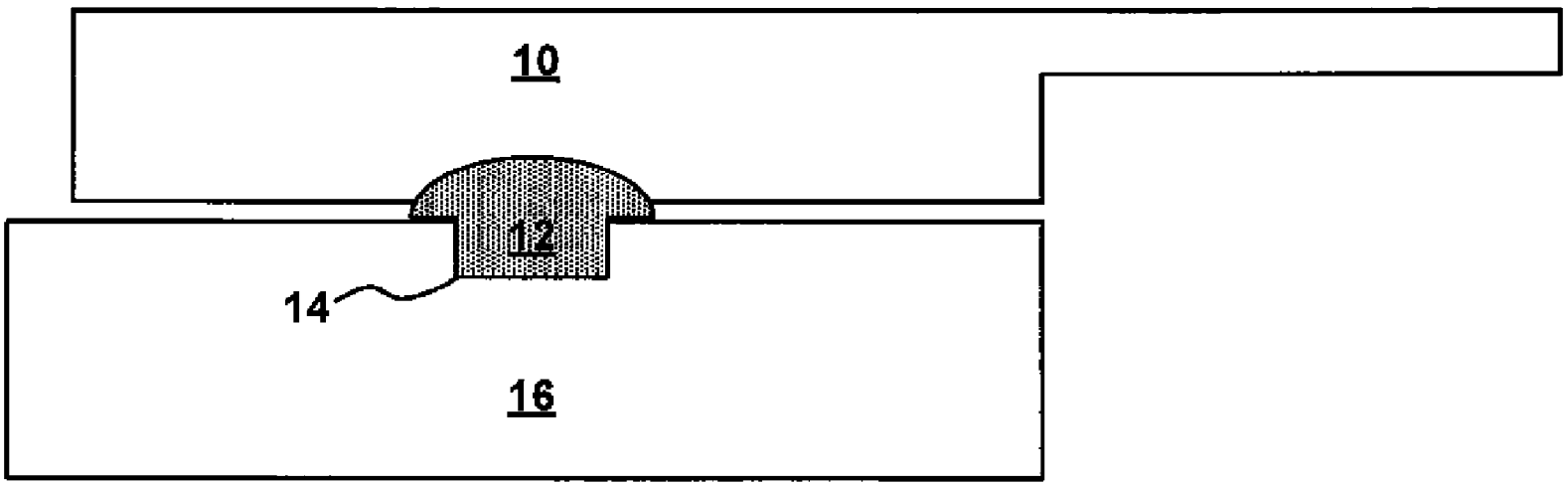
FIG. 1 is a schematic side elevational view, partially in section, of an energetic fill slurry delivery system in accordance with a first embodiment of the invention.

As indicated above, the present invention is particularly concerned with MEMS-based safety and arming devices. It will be understood that a MEMS S&A is not a "sensor" device per se but rather a device wherein the components thereof intrinsically combine both "sense" and "actuate" functions in a single unpowered chip. Although the invention is obviously not limited to use with a particular device, as discussed above, it is particularly advantageously adapted to MEMS S&A devices such as that disclosed in U.S. Pat. No. 6,167,809. Such MEMS S&A devices typically include a secondary explosive transfer charge, as well as, a conventional primary explosive upstream of the transfer charge to initiate the firing train. As discussed above, loading of secondary explosives into the very small volumes associated with the fixtures of MEMS S&A devices presents special problems.

In a preferred embodiment of the subject invention, a first slurry, emulsion, or paste of the secondary energetic material in an aqueous volatile mobile phase, is combined with a second slurry, emulsion or paste of the secondary energetic material in an organic solvent, or mixture of organic solvents, and the resulting slurry, emulsion, or paste is used as the fill for the holes and channels that form the firing initiation train for the subject MEMS S&A device. Once loaded into the MEMS S &A device, the fill dries within about 12-24 hours at ambient temperature, or about 4 hours at an elevated temperature of from about 40 to 65 degrees Centigrade. Further, even though the subject fill has a % TMD of approximately 90%, significantly less than the minimum 95% TMD known within the prior art, the subject fill functions properly as a MEMS firing train, i.e. exhibiting the necessary physical strength and integrity to overcome any tendency to form cracks, porosity, voids, and the like, which can result in unacceptable defects.

Typically plasticizers, either energetic or non-energetic, are incorporated into secondary crystalline explosive formulations to produce increased flexibility. However, no particular benefit has been observed of incorporating such materials within the subject inventive formulation and it may be beneficial, if only from an economic perspective, to omit any plasticizer.

As described above, with a first slurry, emulsion, or paste of the secondary energetic material in an aqueous volatile, preferably a binder system is added which is selected from the group consisting of polyvinyl alcohol, polyvinyl alcohol/polyvinyl ester copolymers, polyacrylates, casein, polyvinyl alcohol/polyvinyl pyrrolidone copolymers, polyvinyl pyrrolidone, substituted polyvinyl pyrrolidone, ethylene-vinyl alcohol/acetate terpolymers, polyurethanes, styrene-maleic anhydride copolymers, epichlorohydrin-based polymers, and styrene-acrylic copolymers.

As described above, with a second slurry, emulsion or paste of the secondary energetic material in an organic solvent, or mixture of organic solvents, preferably, a binder system is added which is selected from the group consisting of polyvinyl alcohol/polyvinyl ester copolymers, polyacrylates, polymethacrylates, poly(vinyl pyrrolidone/vinyl alcohol) copolymers, ethylene-vinyl alcohol/acetate terpolymers, polyurethanes, styrene-maleic anhydride copolymers, styrene-acrylic copolymers, epichlorohydrin-based polymers, oxetane-based polymers, substituted celluloses such as ethyl cellulose and nitrated cellulose derivatives, including the energetic polymers GAP and polyGLYN and oxetane-based polymers such as polyBAMO, polyAMMO, BAMO-AMMO copolymers, and polyNIMMO. The latter are well known energetic polymers and, for example, BAMO is 3,3-bis-azidomethyl-oxetane while AMMO is 3-azidomethyl-3-methyloxetane, and the oxetane thermoplastic elastomer energetic binder is available from Thiokol Corporation.

Depending on the binder system used, the slurry will have different physical properties, such as viscosity, flow ability, leveling, adhesion, and the like. These will all affect the ability to load the material into the desired item. Physical properties of the dried material, such as adhesive strength, flexibility, crush resistance, the sensitivity of the material to external stimuli such as shock and impact, and the like, are also a function of the binder system. These properties can be modified by changing the binder concentration, using a different binder system, or combining two binder systems with separate and distinct sets of properties to provide a system with an array of physical characteristics not available by utilizing a single binder system.

In a unique embodiment, the binder system is prepared by mixing a solution of an aqueous binder with a solution of second organic solvent-soluble binder system—to form a mixed binder system. This mixed binder system can be dissolved in an organic solvent, or in the form of an water-suspended latex. Under normal conditions, the separate binders would be immiscible when the two solvated systems are combined. However, with the appropriate combination of binders, solvents, and mixing conditions, a homogenous mixture is obtained, and when combined with a crystalline energetic material, will result in the preparation of a slurry, emulsion, or paste with physical properties separate and unique from slurries prepared from the single binder systems. As stated above, this mixed binder system fill has a % TMD of approximately 90%, and exhibits physical strength and integrity to overcome any tendency to form the cracks, porosity, voids, and the like, which can result in unacceptable defects. Further, this mixed binder system fill, once dried, has proven to be have enhanced adhesion within MEMS S&A devices, having proven to have good adhesion to aluminum, steel, nickel, glass, and silicon substrates, as well as, having proven to have adequate adhesion to Kapton®, a polyimide film developed and marketed by DuPont.

Depending on the solids loading and its interaction with the binder system, the slurry, emulsion or paste may form strings, in which the apportioned slurry, emulsion or paste remains connected to the dispenser via a thin filament or strand of formulation, similar to the behavior of toothpaste when it is dispensed from the tube. This rheological property of forming thin filaments or strands, i.e. strings, is detrimental to the delivery of the slurry, emulsion or paste to the end item, i.e. the holes or channels within the MEMS S&A device. For example, explosive material that should fill the loading hole will be removed via the string, resulting in a partial fill. Further, the string will be deposited on the surface of the fixture, a safety hazard, and will have to be removed in a secondary process, resulting in additional, unwanted complexity of the loading process. By utilizing a mixed binder system, as described herein, this detrimental rheological behavior can eliminated.

As is believed to be evident from the foregoing, in order to provide a MEMS S&A device that performs reliably, despite the small volume thereof, it is essential that the explosive fill have a high energetic output and a small critical diameter. One explosive fill that meets both requirements is CL-20 (epsilon HNIW), although as discussed below, a number of other fills, such as HMX, RDX, TNAZ, PETN, HNS and others, including all crystalline polymorphs, are also excellent candidates. These other energetic fills are well known in the art and, for example, TNAZ is 1,3,3-trinitroazetidine.

A preferred embodiment would comprise a first slurry, emulsion, or paste of about 65 to 68 weight percent of a secondary energetic material in about 29 weight percent to about 31 weight percent of an aqueous volatile mobile phase and about 5 to 1 weight percent binder, and a second slurry, emulsion or paste of about 65 to about 68 weight percent of a secondary energetic material in about 30 to about 32 weight percent organic solvent, or mixture of organic solvents, and about 5 to about 1 weight percent binder. The combined first aqueous slurry, emulsion or paste being in a weight ratio of about 45:55 to 55:45 with respect to the second organic solvent slurry, emulsion or paste. The combined first aqueous and second organic solvent slurries, emulsions, or pastes, having a % TMD of less than 95%, preferably about 90%.

As indicated above, in accordance with an important feature of the invention, the energetic fill material can be prepared as a slurry, and a number of different liquids can be used as the mobile phase, which can be aqueous or organic in nature. As mentioned, in a preferred embodiment, a mixed system of organic liquids and water are used as the mobile phase, wherein the organic liquid used is selected from the group consisting of ethanol, isopropanol, texanol, dipropylene glycol n-propyl ether, and the like, and a mixture of one alcohol and an ester or ketone, such as ethyl acetate, two alcohols, or esters or ketones without a second solvent.

Within this mixed system the weight percent ratios of aqueous to non-aqueous mobile phases can be from about 15 to 85% and 85 to 10%, respectively; with a preferred range of 35 to 65% and 65 to 35%; and with a most preferred range of 45 to 55% and 55 to 45%. Wherein the organic solvents are used to dissolve the organic soluble binder and prepare the mixed binder matrix. CL-20, and other energetic materials, have minimal solubility in the final mobile phase.

In one important embodiment, the energetic material, e.g., CL-20, is placed in a conductive container, the slurry liquid is added in a dropwise manner, i.e., drop by drop, with a stirring or mixing implement until a paste is obtained. The stirring or mixing implement is preferably made of a metal, conductive plastic, PTFE or the like.

Once the paste of energetic material is produced, a number of different methods, as described herein, can be used to load the paste into the small volume opening of the safe and arm fixture.

In accordance with a loading method in accordance with one important implementation of the invention, the energetic material in the form of a paste is loaded using a swipe loading technique wherein the paste is taken up on a spatula or other wiping element and is swiped or wiped over the hole or opening to be filled. Referring to FIG. 1, a spatula or other blade or wiping element is denoted 10 and a paste including an energetic material is indicated at 12. By wiping element 10 over a hole 14 in a fixture 16, the hole 14 can be filled with the paste 12, as shown.

Figure 2:
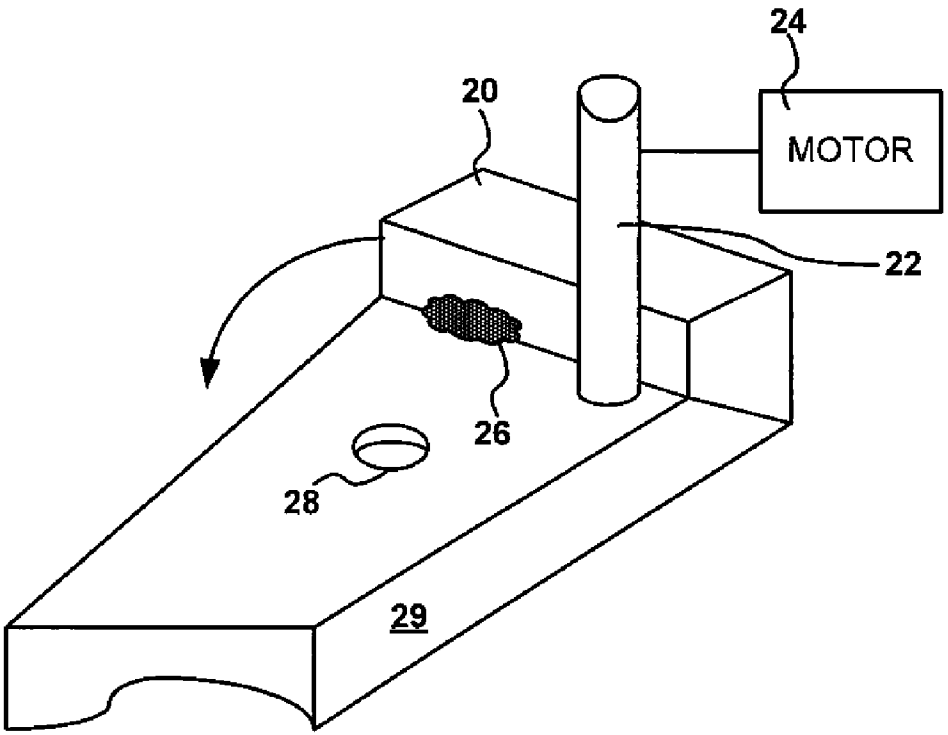
FIG. 2 is a schematic perspective view of an energetic fill slurry delivery system in accordance with a further embodiment of the invention.

It will be appreciated that wiping element can also be part of an automatic wiping apparatus. As shown schematically in FIG. 2, a pivotable blade 20, which is affixed to a rotatable shaft 22 driven by a motor 24, can be used to wipe the energetic fill paste 26 across a loading hole 28 in a fixture 29. It will also be appreciated that the energetic material, denoted 20, can be in a looser slurry form, rather than a paste, and still be forced or dispensed into the volume to be filled.

A specific non-limiting example of this implementation is also discussed below in Example 1.

A loading method in accordance with a further embodiment of the invention involves pressure loading of the energetic material, wherein, broadly speaking, a slurry, emulsion, or paste of energetic material is placed into a container and forced through an orifice in the container into a loading hole in a fixture. This method is illustrated schematically in FIG. 3 which shows a container 30 that is filled with a slurry or paste 32 of energetic material, and that includes a plunger 33. Container 30 also includes an outlet orifice or opening 36. Depressing of plunger 33 causes the energetic material 32 to be expressed out of orifice 34 into a loading hole 36 in a fixture indicated schematically at 38. It will be appreciated that a number of different pressure-loading devices can be used including, for example, pipettes, syringes, and various pumps, including peristalic and positive-displacement pumps. The latter approach is illustrated schematically in FIG. 4 which shows a pump 40 for receiving energetic material 42 in a paste or slurry form and for pumping the energetic material 52 through a delivery tube 44 into loading hole or channel 46 in a fixture 48.

Figure 3:
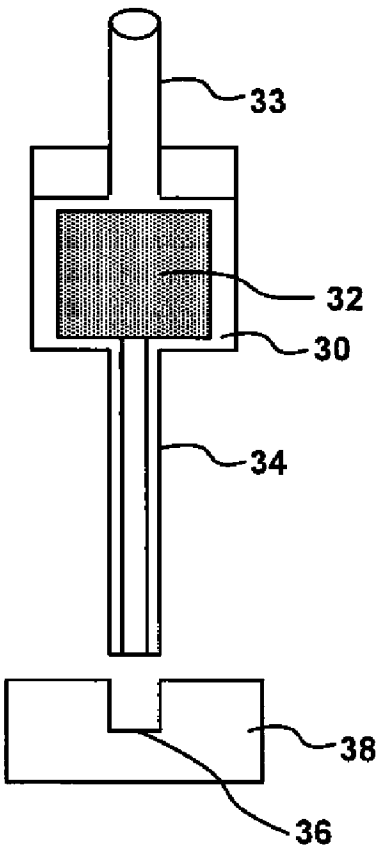
FIG. 3 is a schematic side elevational view, partially in section, of an energetic fill slurry delivery system in accordance with another embodiment of the invention.
Figure 4:
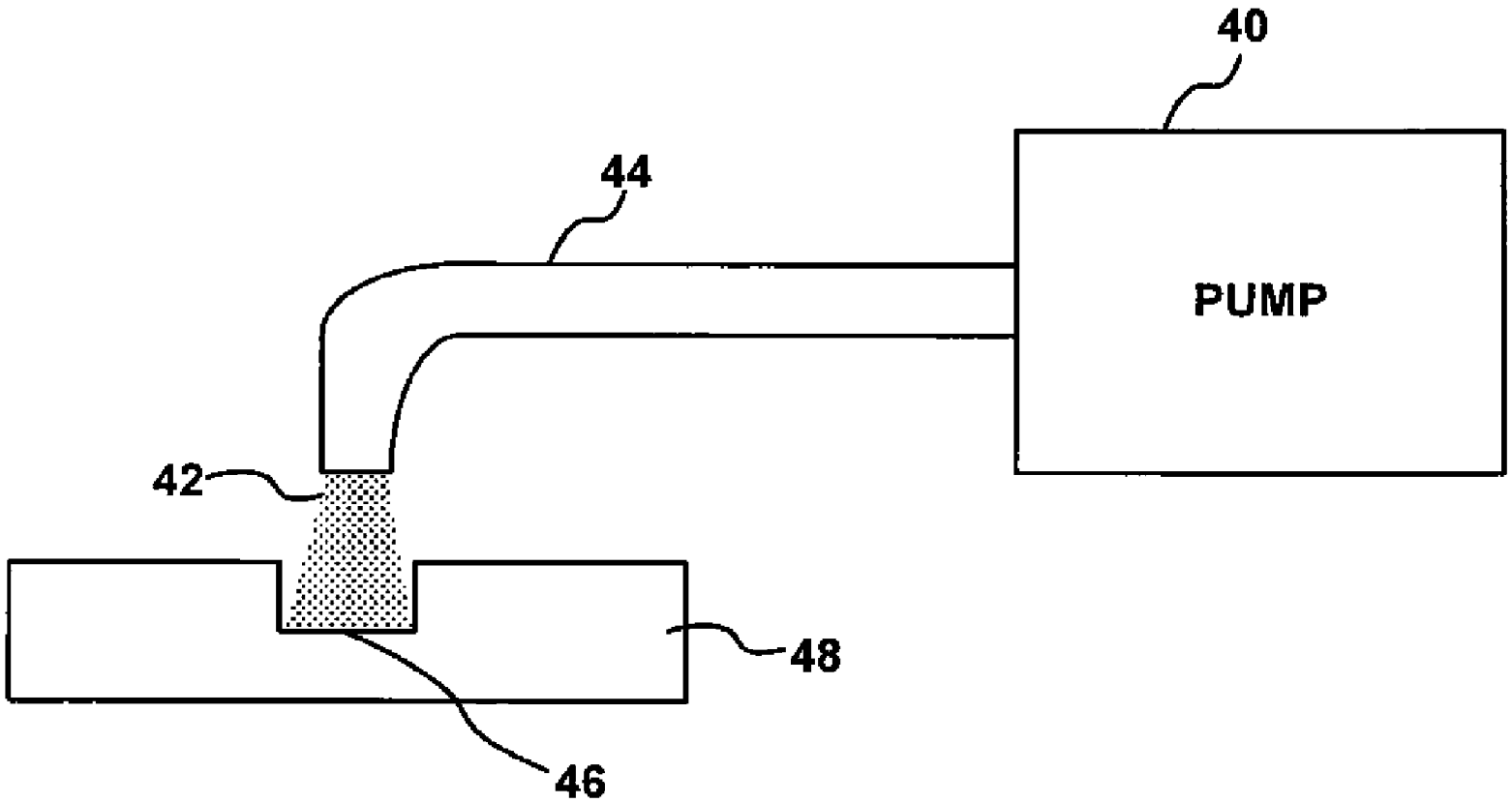
FIG. 4 is a schematic side elevational view of an energetic fill slurry delivery system in accordance with yet another embodiment of the invention.

It will also be appreciated to one of ordinary skill, that the energetic slurry or paste 32 of energetic material, as shown in FIG. 3, is being applied in the form of a thin strip that is the diameter of the pipette or syringe from which it is being expelled or extruded. Therefore, if the fixture 48 or other substrate upon which the energetic material is being applied is repositioned during its application, or if the fixture 48 or substrate is held in place and the pipette or syringe is repositioned, a line of the energetic material can be laid down, or "written", upon the particular substrate, the energetic material forming an "explosive ink." Using this technique a line of energetic material, or group of connected lines of energetic material, can be extruded to form an explosive ink firing train or "written" detonator circuit, that can be used as part of a MEMS S&A device or in other munition. It will further be appreciated that such a detonator circuit of the such explosive ink, that does not exhibit the rheological property of forming thin filaments or strands, will be delivered to the particular holes and channels of the MEMS S&A device, or to any substrate, in a precise manner that is required in a detonator circuit. Further, as stated above, the combined first and second volatile phases, the explosive ink, when applied exhibits physical strength and integrity to overcome any tendency to form the cracks, porosity, voids—another property required in a detonator circuit.

The physical integrity of the loaded energetic fill material can be substantially improved by dissolving a polymeric binder in the mobile phase prior to slurrying of the energetic fill material. In an important implementation, wherein the energetic fill material was CL-20, the polymer coated the CL-20 as well as the metal/plastic surfaces of the loaded fixture when the mobile liquid phase evaporated. A binder loading as low as 0.01-0.5 weight percent with respect to explosive fill, was found to improve the physical integrity of the loaded CL-20 without degrading or interfering with its energetic performance.

In the following Examples, if not stated otherwise, all percentages are weight percentages.

Example 1

A small amount of a CL-20 slurry, prepared as described above, was taken up on a PTFE spatula and wiped over a loading hole in a fixture of an explosive device (as in FIG. 1). The mobile phase was allowed to dry. A loading hole in a second fixture was loaded with lead azide. Upon drying of the slurry mobile phase, an electrical resistance bridgewire was placed in direct contact with the lead azide and connected to the terminals of a battery. The CL-20 energetic material was successfully functioned.

Example 2

A fixture was provided comprising a plate (made of PMMA or aluminum) having a hole drilled through the plate and a trough inscribed on the plate surface so as to be in communication with the hole. CL-20 was incorporated in a slurry with ethanol, and loaded into the hole in the plate with a small volume of the slurry placed in the trough. In addition, lead azide was placed in the trough in direct contact with the CL-20 and so as to partially fill the trough. Lead styphnate was then placed in the trough to fill the remaining trough volume. An electrical resistance bridgewire was placed in direct contact with the lead azide and the bridgewire was connected to the terminals of a battery. The device was successfully functioned and, in this regard, the primary explosives, lead styphnate and lead azide, set off the CL-20 fill material, which carried out a 90° corner turn and made a dent in a lead witness plate disposed in the end of the explosive train. In a closely related example, the device also functioned without the inclusion of lead styphnate in the explosive train.

Example 3

A fixture plate made of PMMA or aluminum having a hole drilled through the plate thickness was provided and the hole was loaded as in Example 1. The device was successfully functioned using a low voltage electric bridgewire, with lead azide being used as the primary initiating explosive.

Example 4

A slurry of CL-20 prepared as in Example 1 was thinned with a few drops of EtOH and taken up in a disposable Pasteur pipette. The tip of the pipette was placed over the loading hole of a fixture plate (as described above) and the bulb of the pipette was squeezed so that a small amount of the thinned slurry was injected into the hole in the fixture.

Example 5

A slurry of CL-20 as described above was thinned with a few drops of EtOH and taken up in a disposable Pasteur pipette. The tip of the pipette was placed in the barrel of a plastic 1-ml syringe. A disposable 18-gauge stainless steel needle, cut down in length to 0.5 inches, was attached to the barrel of the syringe. The aforementioned slurry was loaded into the syringe and the syringe plunger was placed in the barrel. The tip of the needle was positioned over the loading hole in the fixture, the plunger depressed and the required amount of slurry containing the energetic material was injected into the hole in the fixture.

Example 6

An aluminum plate having a through hole therein was prepared. The hole was loaded with a CL-20 slurry as in Examples 1, 4 and 5. Lead azide was placed over the CL-20 slurry and the resultant device was successfully functioned using a low voltage electric bridgewire connected to a battery. Further, a plate prepared as above, and loaded as above, was placed over a second plate or another plate as described above, also loaded with CL-20. The upper plate of the resultant device was functioned and the detonation was successfully transferred from the upper initiating plate to the item placed under the upper plate, resulting in a dent in a lead witness plate.

Example 7

To 2.0 g of water was added 0.25 g of polyvinyl alcohol, a biocide, and a defoamer. The mixture was stirred at room temperature for 60 minutes, then heated at 85-90° C. for 60 minutes. The aqueous solution was cooled to room temperature. Dry CL-20 (2.25 g) was added portionwise with mixing to the solution. A thick, smooth paste was obtained.

A 70:30 weight/weight texanol (2,2,4-trimethyl-1,3-pentanediol monoisobutyrate, Eastman Chemical)/ethanol mixture was prepared. To 2.25 grams of the solution was added 0.25 grams ethyl cellulose (ETHOCEL, Dow Chemical.) The mixture was stirred until the solids had dissolved. Dry CL-20 (2.25 g) was added portionwise with mixing to the solution. A thick, smooth paste was obtained.

The two pastes were then combined and thoroughly mixed. Passing the paste through a three-roll mill gives a homogeneous material. This material was readily loaded into fixtures in the examples described above.

Example 8

Ethyl cellulose (0.25 g) was added to 2 mL of ethyl acetate. The mixture was heated at 50° C. until the solids have dissolved. To 2.0 g of water was added 0.25 g of polyvinyl alcohol, a biocide, and a defoamer. The mixture was stirred at room temperature for 60 minutes, then heated at 85-90° C. for 60 minutes. The aqueous solution was cooled to 40° C. while stirring in a water bath maintained at 40° C. The warm ethyl cellulose solution was poured into the aqueous polyvinyl alcohol solution under rapid stirring conditions. A slow stream of air was passed over the surface of the stirred mixture to remove the ethyl acetate. The solution was regularly weighed until a final weight of 2.5 grams was obtained. If a greater weight loss is obtained, additional water can be added to make up the difference. The white mixture was allowed to cool to room temperature. Dry CL-20 (4.5 g) was added portionwise with mixing to the solution. A thick, smooth paste was obtained. Passing the paste through a three-roll mill gave a well-mixed material. This material was readily loaded into fixtures in the examples described above.

Example 9

Polyvinyl alcohol was added to room temperature water with stirring. The water contained a defoamer and a biocide. Stirring was continued for one hour. The solution was placed water bath and stirred for one hour at 50° C. Ethyl cellulose was mixed with Dowanol DPNP and heated in an 80° C. water bath until it is solvated. Defoamer was added. The solution was placed under a homogenizer. Hot water was added to the solution, and the ingredients mixed by the homogenizer until a homogenous white liquid is formed. The dispersion is complete. The solid content of the dispersion is determined. The polyvinyl alcohol solution and the ethyl cellulose dispersion are mixed together in a one to one ratio of solid polyvinyl alcohol to solid ethyl cellulose. Dry CL-20 (4.5 g) was added portionwise with mixing to the solution containing 0.5 grams binder (0.25 grams polyvinyl alcohol/0.25 grams ethyl cellulose in 2 mL water/Dowanol DPNP.) A thick, smooth paste was obtained. Passing the paste through a three-roll mill gave a well-mixed material. This material was readily loaded into fixtures in the examples described above.

Example 10

If the formulation is prepared by mixing two separate energetic slurries the following procedure is used:

A 70:30 texanol/ethanol mixture was prepared. The mixture had a weight of 9.02 g and a volume of 9.5 mL, resulting in a density of 0.949 g/mL. To this mixture was added 1 g of ethyl cellulose. The mixture was stirred at room temperature until all solids had dissolved. Dry ground CL-20 (9.5 g) was added portion wise with hand-mixing to 5 g of the above solution. A thick, smooth paste was obtained with 31% organic solvent and 66.5% energetic present, the remained is the polymer binder.

Polyvinyl alcohol (30 g) was slowly added to water (70 mL) with rapid stirring at ambient temperature. The mixture was stirred at room temperature for 30 minutes, covered with aluminum foil, then placed in an 85° C. water bath. The mixture was stirred in the bath until the internal temperature reached 83° C. Stirring was continued with heating at 85° C. for 45 minutes. The heating was turned off, and the solution stirred while cooling overnight. Water was added to 3.33 grams of the above solution and stirred until as clear solution was obtained. Dry ground CL-20 (9.5 g) was added portion wise with hand-mixing to 5 g of the above solution. A smooth slurry was obtained, with 30% water present and 66.4% energetic present, the remained is the polymer binder.

The two above slurries were added to a container and hand-mixed until a smooth homogeneous mixture is obtained, with a water/organic ratio of 49:51. The water/organic solvent ratio can be varied from 25:75 to 75:25, but the best loading results are obtained in the range of 45:55 to 55:45, with 50:50 be optimal. The solid energetic percentage range is from 60-75%. With 65-67% being optimal.

Alternatively, the formulation of Example 10 can be prepared by adding the energetic solids to a pre-prepared latex of the ethyl cellulose and polyvinyl alcohol in water/organic solvent, the water/organic range can be 70:30 to 87:13 with the range 80:20-83:17 being optimal. The solid energetic percentage range is from 73-80%, with 75-79% being preferred, and 77-78% being optimal. Such that a particular such pre-prepared latex formulation would be composed of a 73 to 80 weight percent mixture of a secondary crystalline energetic, and 27 to 20 weight percent mixture of latex mixture; the latex mixture preferably formed of about 1 to about 0.5 weight percent ethyl cellulose, about 23 to 27 weight percent polyvinyl alcohol, about 50 to 60 weight percent water and about 13 to about 27 weight percent organic solvent.

Although the invention has been described above in relation to preferred embodiments thereof, it will be understood by those skilled in the art that variations and modifications can be effected in these preferred embodiments without departing from the scope and spirit of the invention.

What is claimed is:

1. A secondary crystalline energetic fill for loading into the small volume loading holes and channels of a MEMS S&A explosive device, said fill comprising:

a 73 to 80 weight percent mixture of a secondary crystalline energetic and 27 to 20 weight percent mixture of a latex mixture;

said latex mixture formed of about 1 to about 0.5 weight percent ethyl cellulose, about 23 to 27 weight percent polyvinyl alcohol, about 50 to 60 weight percent water and about 13 to about 27 weight percent organic solvent; and wherein the fill adheres well to the holes and channels of said MEMS S&A device, has a % TMD less than 95%, and does not form strings when being loaded.

2. A fill according to claim 1, wherein the combined fill has a % TMD of about 90%.

3. A fill according to claim 1, wherein said secondary crystalline energetic is selected from the group consisting of CL-20, HMX, RDX, TNAZ, PETN, HNS and all crystalline polymorphs.

4. A fill according to claim 1, wherein said organic solvent is selected from the group consisting of ethanol, isopropanol, texanol, dipropylene glycol n-propyl ether, and a mixture of one alcohol and an ester or ketone, such as ethyl acetate, two alcohols, or esters or ketones without a second solvent.

* * * * *